US006790090B2

(12) United States Patent
Okamura

(10) Patent No.: US 6,790,090 B2
(45) Date of Patent: Sep. 14, 2004

(54) WATERPROOF CONNECTOR WHICH CAN BE IMPROVED IN ASSEMBLING WORKABILITY

(75) Inventor: Toshio Okamura, Funabashi (JP)

(73) Assignee: Japan Aviation Electronics Industry, Limited, Shibuya-ku (JP)

( * ) Notice: Subject to any disclaimer, the term of this patent is extended or adjusted under 35 U.S.C. 154(b) by 0 days.

(21) Appl. No.: 10/689,093

(22) Filed: Oct. 20, 2003

(65) Prior Publication Data

US 2004/0082222 A1 Apr. 29, 2004

(30) Foreign Application Priority Data

Oct. 28, 2002 (JP) ..... 2002-312270

(51) Int. Cl.[7] ..... H01R 9/03
(52) U.S. Cl. ..... 439/610
(58) Field of Search ..... 439/610, 98, 99

(56) References Cited

U.S. PATENT DOCUMENTS 4,593,964 A * 6/1986 Forney et al. ..... 439/580
5,217,392 A * 6/1993 Hosler, Sr. ..... 439/585
5,618,208 A * 4/1997 Crouse et al. ..... 439/609
5,707,253 A * 1/1998 Matsumoto et al. ..... 439/610
5,800,195 A * 9/1998 Endo et al. ..... 439/271
5,803,767 A * 9/1998 Matsumoto et al. ..... 439/587
5,823,803 A * 10/1998 Majors ..... 439/98
5,833,495 A * 11/1998 Ito ..... 439/610
5,938,475 A * 8/1999 Penner et al. ..... 439/610
6,053,749 A * 4/2000 Masuda et al. ..... 439/98
6,137,056 A * 10/2000 Miyazaki ..... 174/78
6,669,502 B1 * 12/2003 Bernhart et al. ..... 439/460
6,676,446 B2 * 1/2004 Montena ..... 439/583
6,682,360 B2 * 1/2004 Schauer et al. ..... 439/323

FOREIGN PATENT DOCUMENTS

JP 2002056937 2/2002

* cited by examiner

*Primary Examiner*—Ross Gushi
(74) *Attorney, Agent, or Firm*—Collard & Roe, P.C.

(57) ABSTRACT

In a waterproof connector connected to a cable (1) including a core wire and a shield braid, an insert assembly (19) is attached to an end of the cable. A conductive cylindrical barrel (2) is fitted to an outside of the insert assembly and electrically connected to a shield portion (6) formed at the end of the cable by using the shield braid. The barrel has a shoulder portion (21) engaged with the insert assembly in an axial direction thereof. A ground nut (12) is engaged with the cable in the axial direction and screw-engaged with the barrel. The insert assembly includes a cylindrical spacer (7) having one end fitted to the shield portion and a connector element (5) which is connected to an exposed part of the core wire and fitted to an inside of the other end of the spacer.

11 Claims, 6 Drawing Sheets

WATERPROOF CONNECTOR WHICH CAN BE IMPROVED IN ASSEMBLING WORKABILITY

This application claims priority to prior Japanese patent application JP 2002-312270, the disclosure of which is incorporated herein by reference.

BACKGROUND OF THE INVENTION

The present invention relates to a connector to be connected to a cable having a shield braid and, in particular, to a waterproof connector having a waterproof function.

For example, a waterproof connector of the type is disclosed in Japanese Unexamined Patent Publication JP 2002-56937 A. The waterproof connector is to be connected to a cable having a shield braid. Prior to connection of the connector, the shield braid near an end of the cable is folded back outward and a shield tape is wound on the shield braid to form a shield portion. After the above-mentioned process, a connector element is connected to a core wire of the cable. Opposite ends of a cylindrical end bell are fitted to the connector element and the shield portion, respectively. Between the end bell and the shield tape, a shield sleeve is inserted from the outside. Furthermore, a ground nut is screw-engaged with the end bell from the side of the cable. A bushing faced to the shield sleeve in an axial direction is tightly fastened through a sleeve component. Thus, a waterproof space is formed inside the end bell. The core wire and a shield wire are extracted into the waterproof space and connected to terminals of the connector element.

However, when the ground nut is screw-engaged with the end bell, the end bell is movable with respect to the cable. Therefore, a subsequent assembling operation is not easy. Specifically, when the shield sleeve is inserted between the end bell and the shield tape from the outside, the connector element is not fixed to the cable. Therefore, the connector body is shaky and unstable. This becomes an obstacle to the subsequent assembling operation.

SUMMARY OF THE INVENTION

It is therefore an object of the present invention to provide a waterproof connector which can be improved in assembling workability It is another object of the present invention to provide a water proof connector of the type described, by fixing a connector element to a cable in the middle of an assembling operation.

Other objects of the present invention will becomes clear as the description proceeds.

According to an aspect of the present invention, there is provided a waterproof connector connected to a cable which comprises a core wire and a shield braid and has, at its end, a shield portion formed by using the shield braid and an exposed part of the core wire. The waterproof connector comprises an insert assembly attached to the end of the cable and including a connector element connected to the exposed part of the core wire and a cylindrical spacer having one end fitted over the shield portion and another end fitted over the connector element. The waterproof connector further comprises a conductive cylindrical barrel fitted to an outside of the insert assembly and electrically connected to the shield portion. The cylindrical barrel has a first shoulder portion engaged with the insert assembly in an axial direction thereof. The waterproof connector further comprises a ground nut engaged with the cable in the axial direction and screw-engaged with the cylindrical barrel.

According to another aspect of the present invention, there is provided a method of connecting a waterproof connector to a cable which comprises a core wire and a shield braid. The method comprises folding back an end portion of the shield braid outwardly to form a folded braid, wounding a shield tape on the folded braid to form a shield portion, fitting a connector element and a part of the shield portion into opposite ends of a cylindrical spacer, respectively, press-fitting the other part of the shield portion into a shield sleeve thereby forming an insert assembly fixed to the cable, inserting the insert assembly into a housing, and connecting the housing to the cable by the use of a ground nut fitting over the cable.

BRIEF DESCRIPTION OF THE INVENTION

DESCRIPTION OF PREFERRED EMBODIMENT

Figure 1:
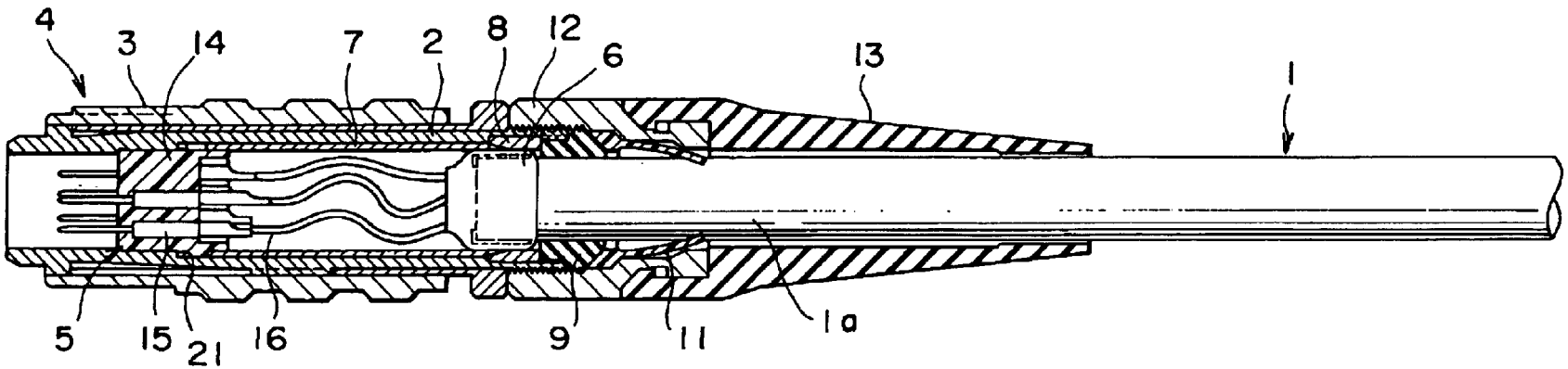
FIG. 1 is a sectional view of a waterproof connector according to an embodiment of this invention when a cable is connected thereto.
Figure 2:
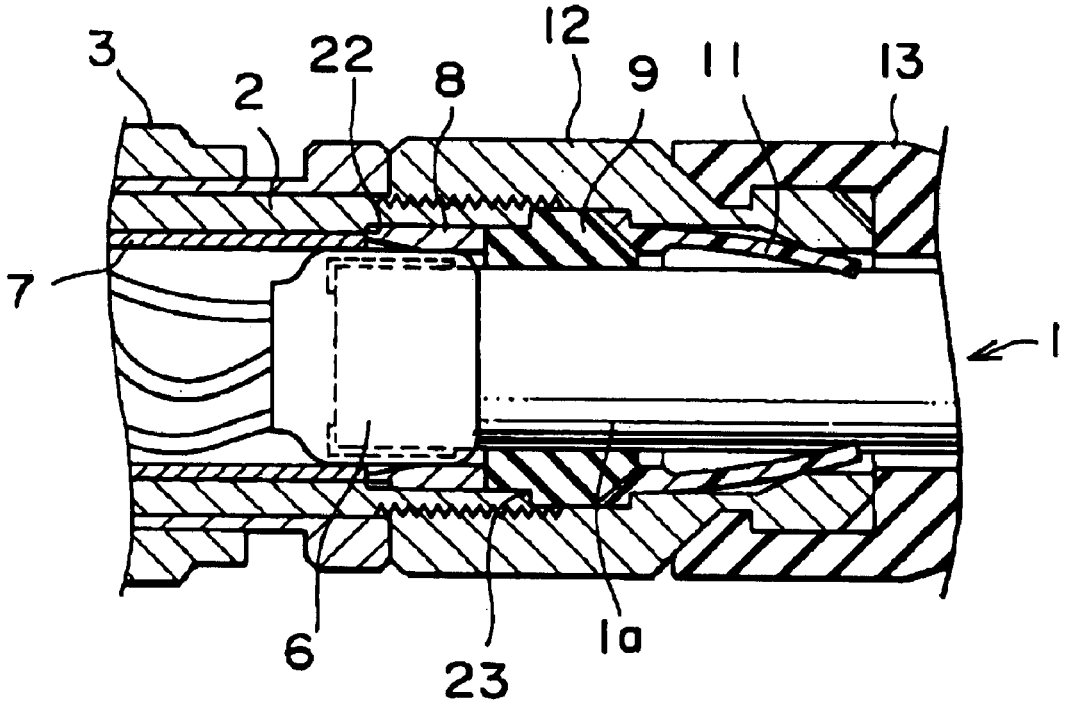
FIG. 2 is an enlarged sectional view of a characteristic part of the waterproof connector in FIG. 1.

Referring to FIGS. 1 and 2, description will be made of a waterproof connector according to an embodiment of this invention.

The waterproof connector illustrated in the figures is to be connected to a coaxial cable 1 having a plurality of conductive core wires 16 and a conductive shield braid 17 surrounding the core wires 16 to serve as a shield wire. The waterproof connector includes a cylindrical housing 4 comprising a conductive cylindrical barrel 2 and a coupling nut assembly 3 made of metal and arranged outside the cylindrical barrel 2. The coupling nut assembly 3 is inserted into a mating connector (not shown) to be locked and connected through one-touch operation. Between the cylindrical barrel 2 and the coupling nut assembly 3, a mechanism is provided which makes the coupling nut assembly 3 rotatable with respect to the cylindrical barrel 2 in a state where axial movement relative to the cylindrical barrel 2 is inhibited. As will become clear later, the cylindrical barrel 2 serves to connect the shield wire of the cable 1 to the mating connector.

The waterproof connector further comprises a connector element 5 disposed inside the cylindrical barrel 2 in the vicinity of its one end, a cylindrical metal spacer 7 disposed inside the cylindrical barrel 2 and having opposite ends fitted to the connector element 5 and a part of a conductive annular shield portion 6 formed near an end of the cable 1, respectively, a conductive annular shield sleeve 8 tightly fitted to the other part of the shield portion 6, an annular rubber bushing 9 fitted to the outside of an insulating coating 1*a* of the cable 1 and faced to the shield sleeve 8 in an axial direction, a plastic cable clamp 11 adjacent to the bushing 9 in the axial direction, a metal ground nut 12 engaged with the cable clamp 11 and screw-engaged with the outside of the other end of the cylindrical barrel 2, and an insulating rubber boot 13 fitted to the insulating coating 1*a* of the cable 1 and engaged with the ground nut 12 in the axial direction. The bushing 9 and the cable clamp 11 are interposed between the shield sleeve 8 and the ground nut 12 in the axial direction and may be called an interposing member.

The connector element 5 comprises an insulator 14 and a plurality of conductive contacts or terminals 15 fixedly held by the insulator 14. The contacts 15 are connected to a plurality of conductive core wires 16 of the cable 1, respectively.

Next referring to FIGS. 3 to 6, description will be made of an assembling operation of the above-mentioned waterproof connector step by step.

Figure 3:
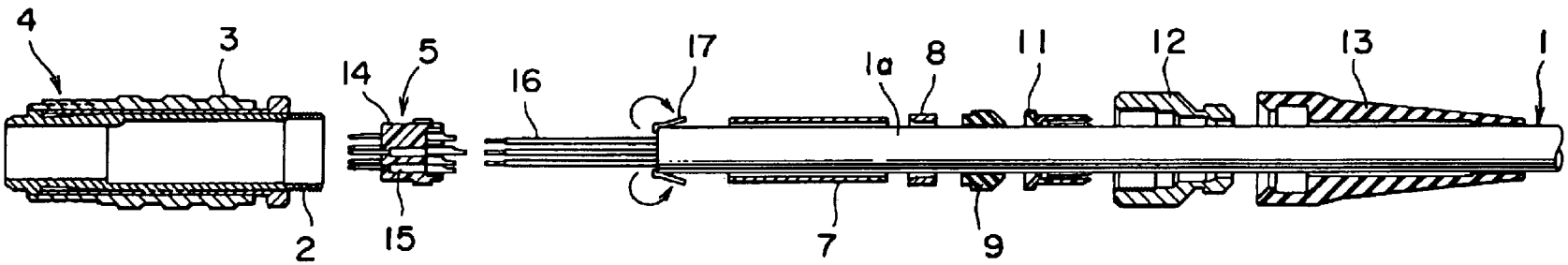
FIG. 3 is a sectional view showing a first step of attaching the waterproof connector in FIG. 1 to the cable.

In a first step illustrated in FIG. 3, the spacer 7, the shield sleeve 8, the bushing 9, the cable clamp 11, the ground nut 12, and the boot 13 are preliminarily attached to the insulating coating 1*a* of the cable 1 into a fitted state in the order reverse to that mentioned above. Then, a coating near the end of the cable 1 is stripped and the shield braid 17 is folded back outward.

Figure 4:
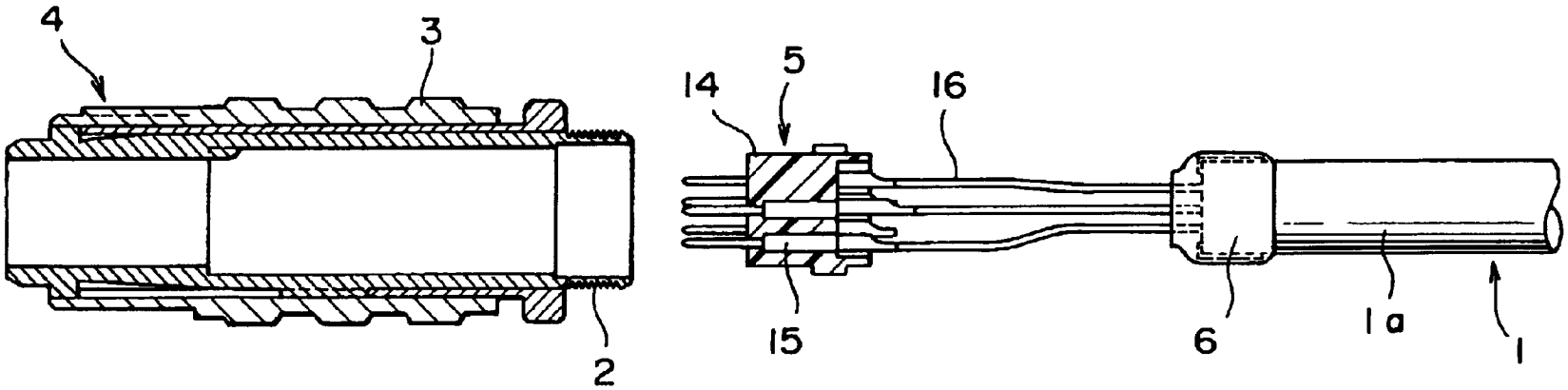
FIG. 4 is a sectional view showing a second step following the first step in FIG. 3.

In a second step illustrated in FIG. 4, a conductive shield tape is wound on the shield braid 17 folded back as mentioned above to form the above-mentioned shield portion 6. The contacts 15 of the connector body 5 are connected to exposed parts of the core wires 16, respectively.

Figure 5:
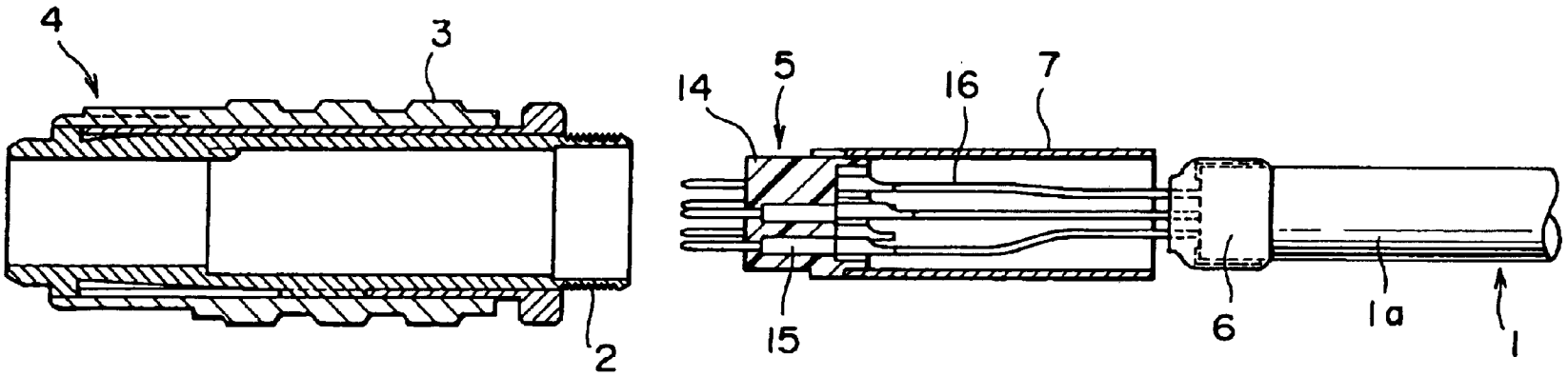
FIG. 5 is a sectional view showing a third step following the second step in FIG. 4.

In a third step illustrated in FIG. 5, the spacer 7 is slid so that its one end is tightly fitted to a part of the outside of the insulator 14 of the connector element 5. In other words, the insulator 14 is press-fitted and fixed to the spacer 7. Since the shield braid 17 of the cable 1 is processed into the shield portion 6, the operation of sliding the spacer 7 can easily be carried out without being interfered by the shield braid 17.

Figure 6:
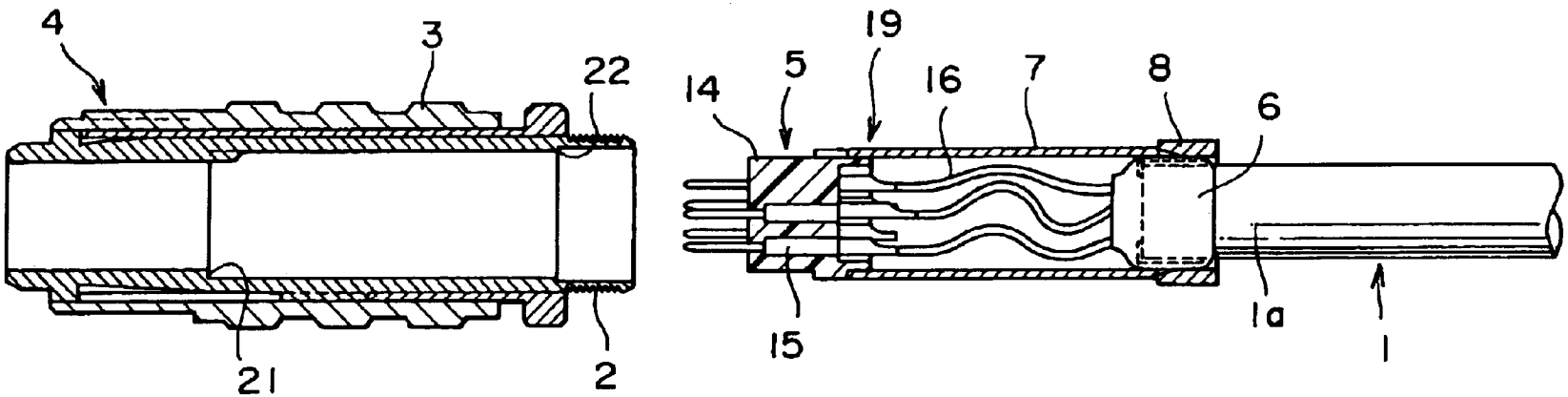
FIG. 6 is a sectional view showing a fourth step following the third step in FIG. 5.

In a fourth step illustrated in FIG. 6, the other end of the spacer 7 is fitted into a part of the shield portion 6. In other words, the shield portion 6 is press-fitted and fixed to the spacer 7. As a result, the core wires 16 are slightly slacked or sagged inside the spacer 7. Furthermore, the shield sleeve 8 is slid and fitted to the other part of the shield portion 6 to be brought into contact with the spacer 7 in the axial direction. In other words, the shield portion 6 is press-fitted into the shield sleeve 8 until it is butted to the spacer 7. Thus, an insert assembly 19 fixed to the cable 1 is formed.

Thereafter, the insert assembly 19 is inserted into the cylindrical barrel 2. At this time, the insulator 14 is engaged with a first shoulder portion 21 formed on an inner surface of the cylindrical barrel 2 so that an axial position is defined. The insert assembly 19 is fixed to the cable 1 and can collectively be inserted into the cylindrical barrel 2. Thus, assembling is easy.

Turning back to FIGS. 1 and 2, description will be made of a final step. The bushing 9, the cable clamp 11, the ground nut 12, and the boot 13 are slid along the cable 1 to approach the insert assembly 19. The ground nut 12 is screw-engaged with the outside or an outer peripheral surface of the cylindrical barrel 2. When the ground nut 12 is tightly fastened, the cable clamp 11 securely clamps the cable 1. As a result, the waterproof connector is mechanically connected to the cable 1.

As the ground nut 12 is tightly fastened, the cylindrical barrel 2 is fitted to the outside of the shield sleeve 8 in a press-contacted state. Simultaneously, the ground nut 12 presses the cable clamp 11, the bushing 9, and the shield sleeve 8 in the axial direction. As a result, the shield sleeve 8 is engaged with a second shoulder portion 22 of the cylindrical barrel 2 in the axial direction. Therefore, the shield portion 6 is reliably electrically connected to the cylindrical barrel 2 through the shield sleeve 8.

Simultaneously, the bushing 9 is brought into press contact with the cable 1 in a radial direction throughout an entire circumference of the cable 1 and is brought into press contact with an axial end of the cylindrical barrel 2 at a seal portion 23. Thus, by the function of the bushing 9, excellent waterproof is obtained.

In the above-mentioned manner, the waterproof connector is reliably electrically and mechanically connected to the cable 1 and is excellent in waterproof.

What is claimed is:

1. A waterproof connector connected to a cable which comprises a core wire and a shield braid and has, at its end, a shield portion formed by using the shield braid and an exposed part of the core wire, the waterproof connector comprising:

an insert assembly attached to the end of the cable and including a connector element connected to the exposed part of the core wire and a cylindrical spacer having one end fitted over the shield portion and another end fitted over the connector element;

a conductive cylindrical barrel fitted to an outside of the insert assembly and electrically connected to the shield portion, the cylindrical barrel having a first shoulder portion engaged with the insert assembly in an axial direction thereof; and a ground nut engaged with the cable in the axial direction and screw-engaged with the cylindrical barrel.

2. The waterproof connector according to claim 1, further comprising a coupling nut assembly fitted to the outside of the cylindrical barrel and rotatable with respect to the cylindrical barrel in a state where axial movement relative to the cylindrical barrel is inhibited.

3. The waterproof connector according to claim 1, wherein the insert assembly further comprises a shield sleeve fitted to the shield portion, the cylindrical barrel is fitted to the outside of each of the cylindrical spacer and the shield sleeve.

4. The waterproof connector according to claim 3, wherein the cylindrical barrel has a second shoulder portion engaged with the shield sleeve in the axial direction.

5. The waterproof connector according to claim 4, further comprising an interposing member interposed between the shield sleeve and the ground nut in the axial direction.

6. The waterproof connector according to claim 5, wherein the interposing member is brought into press contact with the cable and the cylindrical barrel throughout an entire circumference of the cable.

7. The waterproof connector according to claim 5, wherein the interposing member comprises a bushing pressed by the ground nut to be brought into press contact with the cable in a radial direction thereof throughout an entire circumference of the cable and to brought into press contact with an axial end of the cylindrical barrel.

8. The waterproof connector according to claim 5, wherein the interposing member comprises a cable clamp pressed by the ground nut to clamp the cable in a radial direction thereof.

9. A method of connecting a waterproof connector to a cable which comprises a core wire and a shield braid, the method comprising:

folding back an end portion of the shield braid outwardly to form a folded braid;

wounding a shield tape on the folded braid to form a shield portion;

fitting a connector element and a part of the shield portion into opposite ends of a cylindrical spacer, respectively;

press-fitting the other part of the shield portion into a shield sleeve thereby forming an insert assembly fixed to the cable;

inserting the insert assembly into a housing; and connecting the housing to the cable by the use of a ground nut fitting over the cable.

10. The method according to claim 9, further comprising interposing an interposing member between the shield sleeve and the ground nut in an axial direction thereof.

11. The method according to claim 10, wherein the connecting step comprises pressing the interposing member in the axial direction by the ground nut to make the interposing member be brought in press contact with the shield sleeve and the cable.

* * * * *